US005610349A

United States Patent [19]

Fogarty et al.

[11] Patent Number: 5,610,349

[45] Date of Patent: Mar. 11, 1997

[54] PICK FOR MUSICAL INSTRUMENTS WITH IMPROVED GRIP

[76] Inventors: William Fogarty, 22464 Labrador St., Boca Raton, Fla. 33487; Matthew Fogarty, 4970 Alfresco St., Boca Raton, Fla. 33428-4006

[21] Appl. No.: 498,187

[22] Filed: Jul. 5, 1995

[51] Int. Cl.[6] ..... G10D 3/16

[52] U.S. Cl. ..... 84/322

[58] Field of Search ..... 84/320, 322

[56] References Cited

U.S. PATENT DOCUMENTS

| | | | |
|---|---|---|---|
| 4,150,601 | 4/1979 | Henley, Jr. | 84/322 |
| 4,691,609 | 9/1987 | Acocella | 84/322 |
| 5,194,680 | 3/1993 | Reineck | 84/320 |

*Primary Examiner*—Patrick J. Stanzione
*Attorney, Agent, or Firm*—Malloy & Malloy, P.A.

[57] ABSTRACT

An improved pick for playing stringed musical instruments such as guitars, banjos and the like comprising a generally flat pick body sized and configured to be grasped between the thumb and forefinger of a player and including a first end, a second end and surrounding sidewalls that define a tear drop shape, and further including picking means comprising an enlarged, substantially bullet nose shaped portion at the first pick body end for plucking the strings of the musical instrument. The improved pick of this invention further comprises gripping means disposed along the pick body's upper and lower surfaces which preferably comprise a plurality of small, cone shaped members arranged in rows. In a most preferred embodiment, the pick body of the invention will have a wedge or aerodynamic shape.

14 Claims, 1 Drawing Sheet

PICK FOR MUSICAL INSTRUMENTS WITH IMPROVED GRIP

BACKGROUND OF THE INVENTION

1. Field of the Invention

The present invention relates to an improved pick used to play stringed instruments such as guitars, banjos, mandarins, and the like, and is specifically adapted to limit movement of the pick within a player's fingers during the playing of the instrument.

2. Description of the Related Art

In playing a musical instrument such as a guitar, a banjo or the like, musicians frequently utilize a pick to pluck the strings of the instrument. As is commonly known, the pick is a small object which is typically held by the musician between his thumb and forefinger. At one time or another, nearly all musicians encounter difficulties with maintaining a firm grip on the pick. For example, a musician's hand may become tired by the repeated striking of the strings during play of the instrument such that his grip on the pick is loosened. As another example, the musician may begin to sweat while playing the instrument and as this occurs some perspiration often reaches or forms on his hands and fingers. Unfortunately, because picks known in the art are smooth, flat and ultra-thin, as the musician sweats the pick's surface becomes wet and slippery, causing the fingers to slide about on the pick. In either situation, the musician encounters difficulty in controlling the pick's position between the fingers and perhaps worse, is likely to lose and often does lose the pick entirely. The result frequently is an untimely interruption during the playing of a tune during which the musician locates another pick and arranges it in hand.

It would therefore be highly advantageous to musicians who utilize picks for guitars and the like to enable them to use a pick for extended periods of time, thereby minimizing the number of picks which are lost during play as well as the resulting number of interruptions. The improved pick of the present invention is designed specifically to enable the prolonged use of a single pick during the playing of a stringed musical instrument. Thus, the pick of the present invention is adapted to reduce the fatigue that most musicians feel during the repeated striking of the strings on a musical instrument and is further adapted to provide a gripping surface so as to prevent sliding of the fingers on the pick during play.

SUMMARY OF THE INVENTION

The present invention relates to a pick for playing musical instruments such as guitars, banjos and the like. The improved pick of the present invention comprises a generally flat pick body sized and configured to be grasped between the thumb and forefinger of a player and is seen to include a first end, a second end and surrounding sidewalls that define a tear drop shape, and significantly, further includes picking means formed on the first end of the pick body. The picking means comprise an enlarged portion having a substantially bullet nose shape particularly suited for plucking the strings of a musical instrument. The improved pick further includes gripping means disposed along the pick body's upper and lower surfaces, and in the preferred embodiment will be comprised of a plurality of substantially cone-shaped members. In addition, in a more preferred embodiment the improved pick of this invention will include an aerodynamic shape wherein the height of each surrounding sidewall is congruent to the other, is greater at the second end of the pick body, is lesser at the first end of the pick body and gently tapers between the first and second ends.

An object of the present invention is to provide a pick for stringed musical instruments which is adapted to substantially limit movement of the pick within a player's fingers during the playing of a stringed musical instrument.

A feature of the improved pick of the present invention is that it includes an enlarged nose portion at the first end of the pick body having a generally bullet nose shape.

An advantage of the improved pick of the present invention is that it prevents the musician's fingers from sliding downwardly, off the nose of the pick.

Yet another object of the present invention is to provide a pick for stringed musical instruments which will limit the sliding of the fingers on the pick as the pick is used to strike the strings of a musical instrument.

A feature of the improved pick of the present invention is that the exposed upper and lower surfaces of the pick body include gripping means in the form of a roughened surface and preferably, a plurality of tiny cone-shaped elements to prevent sliding of the musician's fingers thereon.

Another object of the present invention is to provide a pick for stringed musical instruments which will allow the musician to maintain a firm grip on the pick by minimizing the fatigue experienced by most musicians during play.

A feature of the improved pick of the present invention is that the exposed upper and lower surfaces of the pick body include in the preferred embodiment, a plurality of tiny cone-shaped elements substantially covering said surfaces and arranged with the tips pointing outwardly which have the advantage of causing the skin of the musician's fingers gripping the pick to tingle and thereby, to limit if not prevent fatigue.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
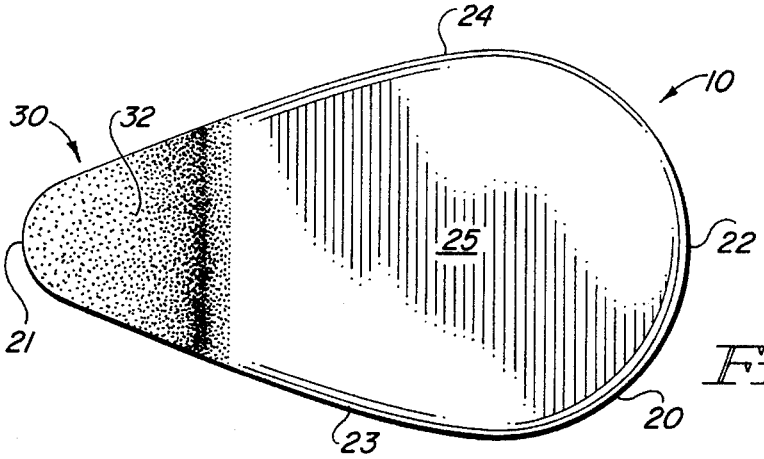
FIG. 1 is a front elevational view of an improved pick for stringed musical instruments according to this invention.
Figure 2:
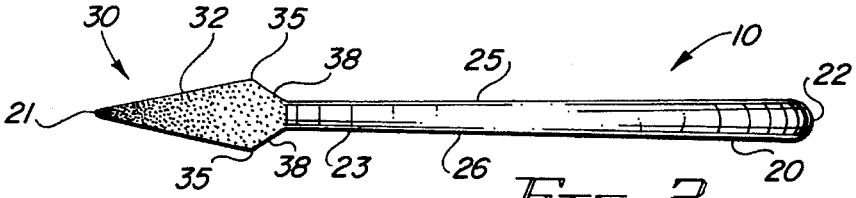
FIG. 2 is a side elevational view thereof.

Shown throughout FIGS. 1–5, the present invention is directed towards an improved pick for use in playing stringed instruments such as guitars, banjos, mandarins, and the like, and is generally indicated as 10. The pick 10, as best illustrated in FIG. 1, is seen to include a pick body 20 which is sized and adapted to be grasped between the thumb and forefinger of a player. In addition, the pick body 20 includes a first end 21, a second end 22, and surrounding sidewalls 23, 24, and in the preferred embodiment define a tear drop shape. Also, as shown in FIGS. 1 and 2, the pick body includes an upper exterior surface 25 and a lower exterior surface 27 which are level, and substantially co-planar to each other and which together, define a generally flat pick body. The pick body 10 is preferably formed of a substantially strong, solid, yet lightweight material such as nylon although other polymers and other material can be utilized as well and in a most preferred embodiment, the pick body will comprise a rigid unitary material.

As shown throughout the figures, the improved pick of this invention 10, is seen to include picking means at the first end 21 of the pick body, generally indicated as 30, for striking the strings of the guitar or other stringed instrument. Preferably, the picking means 30 are formed on and are integral with said pick body and further, will comprise an enlarged portion 32. In the preferred embodiment, enlarged portion 32 both extends out of the generally flat plane defined by the upper and lower exterior surfaces 25 and 26 of the pick body and includes a substantially bullet nosed shape which terminates in a tip or edge 50, (best seen in FIG. 5) that is especially suited for striking the strings of a musical instrument. It will be appreciated by those skilled in the art that as a musician strikes the strings of guitar or similar stringed instrument with a pick, the forces which are operating often cause the musician's fingers to slide downwardly towards the nose of the pick and given the repeated motion of picking the guitar strings, the fingers frequently slide off the pick nose entirely. Thus, the enlarged nose portion 32 is a significant improvement over picks known in the art because it acts to limit if not prevent altogether, the downward sliding of a musician's fingers off the nose of the pick. Moreover, enlarged nose portion 32 can be said to act as a finger-stop which may enhance the musician's ability to be consistent with his strumming of the instruments strings. Further, it can also be said that by having an enlarged nose portion 32 the pick of this invention exposes more of the pick to strum the strings and this is desirable for musicians who wish to play rhythm or lead.

Also, in a most preferred embodiment, enlarged portion 32 assumes a generally arrow head shape wherein it is seen to taper from its highest point 35 to both form the nose at first body end 21 for plucking the strings of the instrument, as well as a reclining back wall 38 along a lower part thereof which joins with pick body surfaces 25, 26. As shown in FIG. 2, reclining back wall 38 of enlarged nose portion 32 is seen to taper to join with pick body 20 at an angle substantially less than a right angle or 90 degree angle to the pick body 20. It will be appreciated that if back wall 38 were formed at a right angle to the pick body for example, this would frequently result in the strings of the instrument getting caught or snagged thereon, which interferes with the playing of a tune as well as distorts the sound produced. To avoid this, reclining back wall 38 of enlarged nose portion 32 is seen to have an angle of generally 45 degrees from highest point 35 back to the pick body 20.

Figure 3:
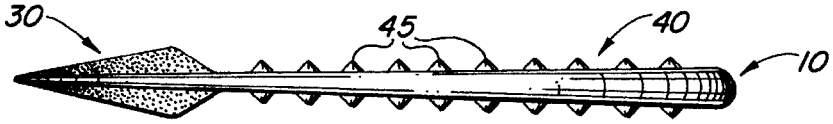
FIG. 3 is a side elevational view of a preferred embodiment of the improved pick for stringed musical instruments according to this invention.
Figure 4:
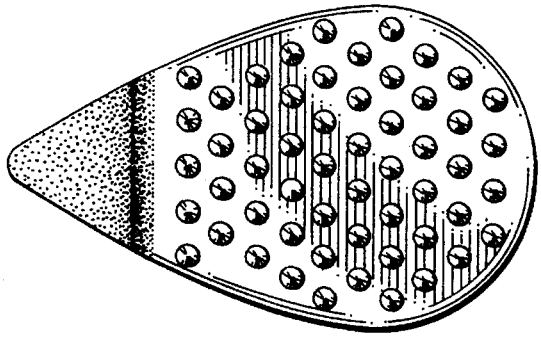
FIG. 4 is a front elevational view of the pick shown in FIG. 3.
Figure 5:
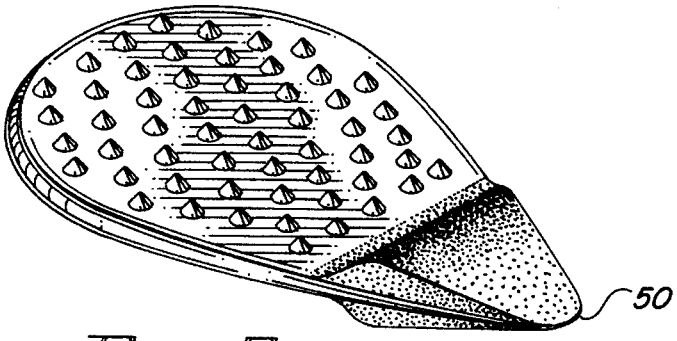
FIG. 5 is a perspective view of an improved pick according to this invention such as that shown in FIG. 3, and having a more exaggerated aerodynamic shape.

Additionally, the improved pick of this invention is seen to include gripping means 40 along the pick body. Generally, the gripping means extend along at least one of the pick body's exterior surfaces 25 or 26, although preferably both, and may be in the form of providing a roughened surface thereon such as cutting grooves into the surfaces or imprinting a grid thereon. However, in the preferred embodiment, the gripping means will comprise a plurality of cone shaped members 45 formed on and integral with pick body 20, and as illustrated in FIGS. 3 through 5, cones 45 are seen to be arranged along both of the pick body's exterior surfaces 25 and 26, with the cone tip facing outwardly. In the most preferred embodiment, the cones are formed only on the pick's body surface and do not extend below that surface and further, are arranged in rows which helps to ensure placement over substantially all of the pick body's upper and lower surfaces as well as to assist with manufacturing of the pick 10. It will be understood that the size of cones 45 is very small, preferably about 1/32" high, such that a large number of them can be arranged on the pick. Further, the cones' tips are not very sharp so as to be likely to prick, scrape or injure the fingers of the musician but rather, are preferably a bit dull and act to stimulate the skin of the fingers, including the nerve endings therein. It will therefore be appreciated that the cones 45 are especially suited to reduce the fatigue that most musicians feel during the repeated striking of the strings on a musical instrument. Moreover, cones 45 provide a gripping surface so as to substantially limit if not entirely prevent the sliding of the fingers on the pick during play.

As shown in FIGS. 3 and 5, the pick body of this invention may be formed to have an aerodynamic shape. In this embodiment, as in the previous embodiment, surrounding sidewalls 23, 24 are formed of a height congruent to each other thereby defining a level upper exterior surface 25 and a level lower exterior surface 26. The aerodynamic shape of the pick body however, is formed by a tapering of the sidewalls from a greater height at the pick body's second end 22 to a lower height at the pick body's first end 21. It will be appreciated that this aerodynamic shape permits the height of the pick body to be varied in that the height of the surrounding sidewalls 25, 26 at second end 22 of pick body can be lower in one embodiment to offer a more flattened pick body, such as shown in FIG. 3, or can be greater in another embodiment to offer a thicker pick body such as shown in FIG. 5. The offering of variety for the thickness of the pick body is important in that some musicians believe that playing with a heavier or thicker pick body such as illustrated in FIG. 5 will result in the instrument producing a brighter, more clear sound whereas the thinner, more flat pick body will produce a lighter sound.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A pick for stringed musical instruments, comprising:

a pick body adapted to be grasped between the thumb and forefinger of a player, said body having a first end, a second end and surrounding sidewalls defining a substantially tear drop shape, said body further including an upper, exterior surface and a lower, exterior surface, said surrounding sidewalls further defining an aerodynamic shape for said body in that each of said sidewalls is formed of a height which is congruent, thereby making each of said upper and lower exposed surfaces level, and said height of said sidewalls being greater at said second body end than at said first body end such that said height of said sidewalls between said upper and lower body surfaces is tapered between said ends, from said greater height at said second body end to a smaller height at said first end, picking means formed on said first end of said body for picking strings of the instrument, said picking means including an enlarged portion extending out of a plane defined by said upper and lower exterior surfaces of said pick body, said enlarged portion of said picking means having a substantially bullet nosed shape structured and adapted for picking strings of the instrument, gripping means formed on at least one of said exterior surfaces of said pick body, for providing the player with a firm grip on said pick, and said gripping means being defined by a plurality of cone shaped members, each of said cone members being arranged with a tip thereof pointing outwardly.

2. A pick as recited in claim 1 wherein said enlarged nose portion of said picking means includes along a rear part thereof, a reclining back wall which merges with said pick body.

3. A pick for stringed musical instruments, comprising:

a generally flat body adapted to be grasped between the thumb and forefinger of a player, said body having a first end, a second end and surrounding sidewalls defining a substantially tear drop shape;

picking means formed on said first end of said body for plucking the strings of an instrument, said picking means including an enlarged portion which extends out of a plane defined by said generally flat body and having a substantially bullet nosed shape structured which is sized and configured for plucking the strings of the instrument;

gripping means on a main face of said pick body for providing the player with a firm grip on said pick body; said gripping means comprising a plurality of cone shaped members formed on and integral with said main face and said pick body; and said cone members being arranged with a tip thereof pointing outwardly.

4. A pick as recited in claim 3 wherein said cone shaped members are arranged in rows over both an upper and a lower exterior exposed surface defined by said pick body so as to substantially cover both of said surfaces.

5. A pick as recited in claim 3 wherein said picking means terminate in a tip edge at said first end of said pick body.

6. A pick as recited in claim 5 wherein said enlarged portion further comprises a reclining back wall which merges with said pick body at a lower part thereof.

7. A pick as recited in claim 6 wherein said reclining back wall of said arrow head shape tapers to merge with said pick body at an angle substantially less than 90 degrees.

8. A pick as recited in claim 3 wherein said enlarged portion forming said picking means includes a generally arrow-head shape.

9. A pick for stringed musical instruments, comprising:

a generally flat body adapted to be grasped between the thumb and forefinger of a player, said body being formed of a rigid, nylon material and having a first end, a second end and surrounding sidewalls defining a substantially tear drop shape; and picking means formed on said first end of said body for plucking the strings of an instrument, said picking means including an enlarged portion which extends out of a plane defined by said generally flat body and having a substantially bullet nosed shape structured which is sized and configured for plucking the strings of the instrument.

10. A pick for stringed musical instruments, comprising:

a generally flat body adapted to be grasped between the thumb and forefinger of a player, said body having a first end, a second end and surrounding sidewalls defining a substantially tear drop shape;

said body being defined by an upper, planar exterior surface and a lower, planar exterior surface;

picking means formed on said first end of said body for plucking the strings of an instrument, said picking means including an enlarged portion which extends out of a plane defined by said generally flat body and having a substantially bullet nosed shape which is sized and configured for plucking the strings of the instrument;

gripping means formed on both of said exterior surfaces for providing the player with a firm grip on said pick body; said gripping means comprising a plurality of cone shaped members formed on at least one of said exterior surfaces of said pick body; and said cone members being arranged with a tip thereof pointing outwardly.

11. A pick as recited in claim 10 wherein said cone shaped members are arranged in rows over both an upper and a lower exterior exposed surface defined by said pick body so as to substantially cover both of said surfaces.

12. A pick as recited in claim 10 wherein said cone shaped members have a generally small size.

13. A pick as recited in claim 12 wherein said small size of said cone shaped members is about 1/32 of an inch high.

14. A pick as recited in claim 10 wherein said tip of said cone shaped members is not very sharp.

* * * * *